US007410411B2

(12) United States Patent
Borucki et al.

(10) Patent No.: US 7,410,411 B2
(45) Date of Patent: Aug. 12, 2008

(54) METHOD OF DETERMINING THE NUMBER OF ACTIVE DIAMONDS ON A CONDITIONING DISK

(75) Inventors: Leonard Borucki, Mesa, AZ (US); Naoki S. Rikita, Saitama (JP)

(73) Assignees: Araca, Incorporated, Tucson, AZ (US); Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 11/528,835

(22) Filed: Sep. 28, 2006

(65) Prior Publication Data

US 2008/0078231 A1 Apr. 3, 2008

(51) Int. Cl.
*B24B 1/00* (2006.01)
*G01N 3/56* (2006.01)

(52) U.S. Cl. ..... 451/56; 451/28; 451/41; 451/443; 451/287; 451/288; 73/7

(58) Field of Classification Search ..... 451/28, 451/41, 56, 443, 444, 287, 288; 73/7
See application file for complete search history.

(56) References Cited

U.S. PATENT DOCUMENTS 6,551,176 B1 * 4/2003 Garretson ..... 451/56
6,824,447 B2 * 11/2004 Takahashi et al. ..... 451/6
7,011,566 B2 3/2006 Chandrasekaran
7,081,037 B2 * 7/2006 Berman et al. ..... 451/5
7,175,510 B2 * 2/2007 Skocypec et al. ..... 451/56
2004/0038623 A1 2/2004 Chandrasekaran

FOREIGN PATENT DOCUMENTS

GB 2 326 166 A 12/1998

OTHER PUBLICATIONS

Bubnick, et al., "Effects of Diamond Size and Shape on Polyurethane Pad Conditioning," *Abrasive Technology TechView,* (2004). Retrieved on Oct. 13, 2006 from: http://www.abrasive-tech.com/pdf/effectsdiamond.pdf.
Bubnick, et al., "Optimizing Diamond Conditioning Disks for the Tungsten CMP Process," *Abrasive Technology TechView,* (2002). Retrieved on Oct. 13, 2006 from: http://www.abrasive-tech.com/pdf/tcmptungsten.pdf.
Goers, et al., "Measurement and Analysis of Diamond Retention in CMP Diamond Pad Conditioners" (Mar. 14, 2000).
Dyer, et al., "Characterizing CMP Pad Conditioning Using Diamond Abrasives", *Micro,* (Jan. 2002).

(Continued)

*Primary Examiner*—Joseph J. Hail, III
*Assistant Examiner*—Shantese L McDonald
(74) *Attorney, Agent, or Firm*—Leydig, Voit & Mayer, Ltd.

(57) ABSTRACT

The invention relates to a method for determining the number of active diamonds on a conditioning disk. In particular, the method comprises (a) contacting a diamond conditioner disk with a hard surface, wherein the diamond-containing side of the diamond conditioning disk is facing the hard surface, (b) moving the diamond conditioner disk under a load across the hard surface so as to cause any active diamonds present on the diamond-containing side of the diamond conditioner disk to leave a mark corresponding to each active diamond, and (c) counting the marks to determine the number of active diamonds on the diamond conditioner disk.

31 Claims, 7 Drawing Sheets

OTHER PUBLICATIONS

Zimmer, et al., "Key Factors Influencing Performance Consistency of CMP Pad Conditioners," *Diabond® Technical Articles, Morgan Advanced Ceramics,* Retrieved on Oct. 13, 2006 from: http://www.diamonex.com/diabond_key_factors.htm.

Thear, et al., "Improving Productivity Through Optimization of the CMP Conditioning Process," *Technical Articles, Morgan Advanced Ceramics*(Feb. 17, 2004). Retrieved on Oct. 13, 2006 from: http://www.morganadvancedceramics.com/articles/cmp_optimization.htm.

* cited by examiner

METHOD OF DETERMINING THE NUMBER OF ACTIVE DIAMONDS ON A CONDITIONING DISK

BACKGROUND OF THE INVENTION

Diamond conditioner disks have been used in CMP processes to great effect to maintain the roughness of polyurethane polishing pads. These disks have been produced and marketed by several vendors to standards of reliable quality and effectiveness. Generally, diamond conditioner disks are evaluated based on, among other things, the total number of diamonds present on the surface of the disk and the number of diamonds remaining after certain specified periods of use or environmental testing. However, the effectiveness of the diamond conditioner disk actually depends not upon the total number of diamonds present on the surface of the disk but upon the number of active diamonds present.

Active diamonds are the diamonds that actually contact and abrade the surface of the CMP pad during CMP processing. The diamonds on more topographically prominent areas of the surface of the diamond conditioner disk and, where diamonds are collected together on the surface of the disk, diamonds that are further from the disk surface than others will, from a simple geometric standpoint, be more available to contact a surface such as that of a CMP pad brought into contact with the diamond conditioner disk. The number of active diamonds present in any given situation depends upon the total number of diamonds on the diamond conditioner disk, their grouping, the surface characteristics of the diamond conditioner disk including the topography and the load on the diamond conditioner disk. Although simple microscopic examination of diamond conditioner disk sectors and estimation based on the geometric patterns of initial diamond placement and surface area have long provided a method to determine an approximate total number of diamonds on the surface of a diamond conditioner disk, to date there has been no simple, reliable, cost effective method to measure the number of active diamonds.

If the number of active diamonds on the surface of a diamond conditioner disk could be determined easily, this would allow manufacturers to control and better maintain the quality of the disks in terms of their actual effectiveness in abrading the CMP pad during CMP processing. The surfaces of diamond conditioner disks are not perfectly planar and the grouping of diamonds may vary depending upon the production method and specific topography of the diamond conditioner substrate surface. Additionally, the diamonds may be grouped differently on different disks or on disks made where the diamonds are added by different processes. Although disks may have the same total number of diamonds, because of the aforementioned variations in disk topography and diamond grouping, there may be considerable variation from disk to disk in the number of active diamonds and consequently in how effectively these diamond conditioner disks can abrade the surface of the CMP pad.

To date, no effective counting method has been disclosed and manufacturers and users have had to rely on such essentially ineffective methods as estimating the total number of diamonds present on the conditioner disk surface.

For example, U.S. Pat. No. 7,011,566 describes a method for determining how effectively conditioning of the CMP pad is being conducted. However the method taught by the '566 patent reveals neither the total number of diamonds nor the number of active diamonds on the diamond conditioner substrate.

Similarly, in Bubnick et al., "Effects of Diamond Size and Shape on Polyurethane Pad Conditioning," Abrasive Technologies, 2004, available at http://www.abrasive-tech.com/pdf/effectsdiamond.pdf, the size and shape of diamonds are taught to be important for the effective life of the diamond conditioner but neither the total number of diamonds nor the number of active diamonds are either determined or considered.

Also in Bubnick et al., "Optimizing Diamond Conditioning Disks for the Tungsten CMP Process," Abrasive Technologies, 2002, available at http://www.abrasive-tech.com/pdf/tcmptungsten.pdf, the authors teach that manipulation of "diamond concentration" together with other diamond characteristics can be instrumental in lengthening diamond life on diamond conditioners but fail to teach how to determine diamond concentration generally, or active diamond concentration in particular.

Additionally, in Goers et al., "Measurement and Analysis of Diamond Retention in CMP Diamond Pad Conditioners," 2000, the authors refer to specific alignment and placement of diamonds at the microscopic level on diamond conditioners which would enable one to generally determine the total number of diamonds on the surface of the diamond conditioner disk; however, the number of active diamonds cannot be calculated or estimated from the total number of diamonds alone. The difference in the number of active diamonds to total surface diamonds is at least two to three orders of magnitude. Goers et al. does not provide either a description of active diamonds, a discussion of their importance or a means of determining how many active diamonds are present.

In Dyer & Schlueter, "Characterizing CMP pad conditioning using diamond abrasives", the authors refer to determining "diamond loss" by microscopic examination of diamonds on the surface of the diamond conditioner disk. In addition to diamonds placed individually on a predetermined grid on the diamond conditioner surface, diamonds arranged in clusters of 1-9 from which an estimate of total diamond number could be made are given but, again, no reference is made to the existence or determination of the number of active diamonds.

In Zimmer & Stubbmann, "Key factors influencing performance consistency of CMP pad conditioners," available at http://www.diamonex.com/diabond_key_factors.htm, the authors discuss the concept of "working grit density", which is defined as "the total amount of grit in contact with the pad divided by the total area of the conditioner." The authors teach that working grit density can be measured "by inspecting the conditioner after usage and counting the number of grit particles which show physical wear compared to the total number of grit particles within a given area. The ratio of the two densities can then be used as a figure of merit for the quality of the conditioner." Similarly in Thear & Kimock, "Improving productivity through optimization of the CMP conditioning process," available at http://www.morganadvancedceramics.com/articles/cmp_optimization.htm, the authors define "working grit density" as "the number of grit particles that show physical wear compared to the total number of grit particles within a given area. This calculation is made by inspecting the conditioner after use and is used to indicate the quality of the conditioner." However, the post-usage visual inspection procedures taught by these references can only be used effectively on a worn disk and provide no direct information on the active diamond count at various stages of life. In addition, it is difficult to distinguish between diamonds that wear because they are cutting the pad and those that wear because they make contact but do not cut.

Users of diamond conditioner disks need to know that they are receiving the same quality of product from diamond conditioner disk manufacturers from the standpoint of process effectiveness on a consistent basis and such a test would allow users to better determine specifications for what they require. Users may also want to know how well their disks are faring under certain operating conditions and an accurate method of determining active diamonds on the diamond conditioner disk will provide them with useful information in that regard. Finally, from a research and development standpoint, the results of such a test would provide makers of diamond conditioner disks with more useful information about how to improve existing manufacturing processes for diamond conditioner disks or in the development of new CMP and related processes.

The present invention seeks to provide an accurate and consistent method for determining the number of active diamonds on a conditioner disk. These and other advantages of the invention will be apparent from the description of the invention provided herein.

BRIEF SUMMARY OF THE INVENTION

The invention provides a method for determining the number of active diamonds on a conditioning disk. In particular, the method comprises (a) contacting a diamond conditioner disk with a hard surface, wherein the diamond-containing side of the diamond conditioning disk is facing the hard surface, (b) moving the diamond conditioner disk under a load across the hard surface so as to cause any active diamonds present on the diamond-containing side of the diamond conditioner disk to leave a mark corresponding to each active diamond, and (c) counting the marks to determine the number of active diamonds on the diamond conditioner disk. In a preferred embodiment, the hard surface further comprises a layer of contrasting material such that when the diamond conditioner disk moves across the hard surface, the diamond conditioner disk passes the layer entirely from one end to the other and scratches the layer of the hard surface thereby leaving a mark.

BRIEF DESCRIPTION OF THE SEVERAL VIEWS OF THE DRAWING(S)

DETAILED DESCRIPTION OF THE INVENTION

Figure 1:
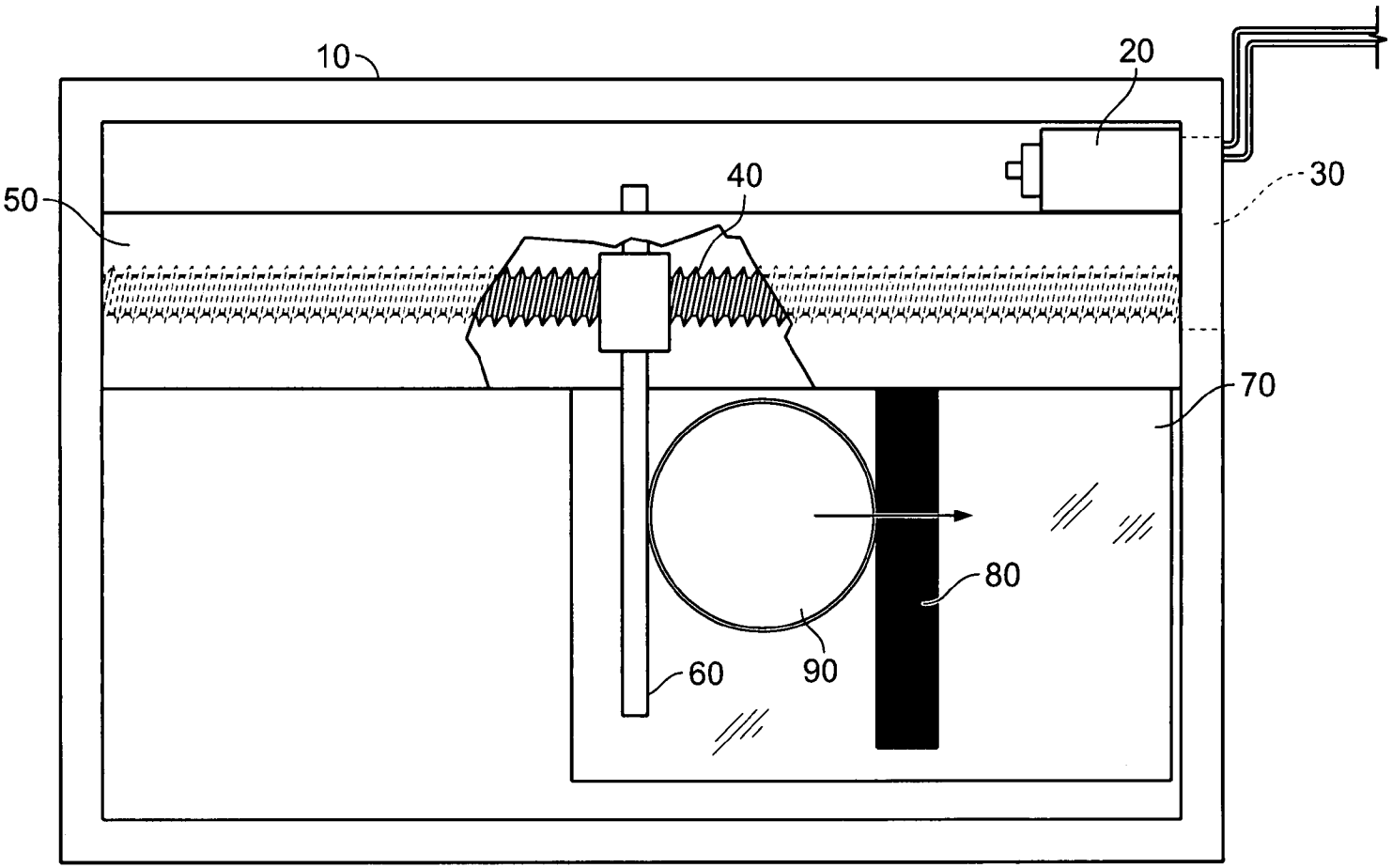
FIG. 1 is a top view of a mechanical device for moving the diamond conditioner disk across the hard surface.

Applicants have developed a method for accurately and consistently determining the number of active diamonds on the surface of a diamond conditioner disk. They discovered that by moving the diamond conditioner disk under a load (e.g., a fixed load) across a hard surface, wherein the diamond-containing side of the conditioner disk is facing and contacting the hard surface, and upon which hard surface optionally a layer of contrasting material has been attached or a tinted, dyed or pigmented layer has been prepared of a color that is distinguishable from that of the hard sheet by optical or other means, so that the movement of the conditioner disk passes it entirely from one end to the other across the layer, the active diamonds on the disk would mark or scratch through the hard surface and/or layer of contrasting material, if present, and the resulting marks (e.g., scratches) can be counted by optical microscope or other suitable means.

More specifically, Applicants found that by (i) placing a rectangular polycarbonate sheet of dimensions on the order of about 8 by about 10 inches and about 3/32 inch thick on a flat work surface with suitable restraints to horizontal and vertical motion, (ii) marking a narrow band of constant width of on the order of four to five inches long using a dark indelible felt tipped marker across the upper surface of the said sheet perpendicular to the longer axis of the said sheet, (iii) placing the diamond conditioner disk with the lead edge at or near the beginning of the band, (iv) placing a load on the diamond conditioner disk so that the total load was on the order of up to about 25 pounds and (v) mechanically dragging the diamond conditioner disk at a constant velocity of on the order of about 1-2 inches per second parallel to the longer axis of the sheet so that the disk surface passes over the felt marker band and when the movement of the disk has stopped the trailing edge of the diamond conditioner disk reaches or is separated therefrom, and (vi) finally counting the resulting scratches across the indelible felt marker contrast band under an optical microscope, the number of active diamonds at that load could easily and reproducibly be determined.

Applicants have also found that the number of diamonds can be counted by determining the number of scratches through other non-optical means such as by use of a profilometer and that in this case there is no necessity of creating an optical contrast using a felt tip marker band or like device though, of course, both methods may be used simultaneously under appropriate conditions.

The number of active diamonds counted varies depending upon the alignment of the diamond conditioner disk during the test. Such variation is understandable given the nature of the factors determining whether a diamond is active or not. However, the difference between the maximum and minimum count for active diamonds is orders of magnitude smaller than the total number of diamonds on the conditioner disks, which can number in the hundreds of thousands. Thus even with some variation depending upon direction, it is possible to characterize a conditioner disk by its "range" of values obtained using the methods of the present invention.

In addition, Applicants further discovered that by pushing the conditioner disk only a short distance on the order of about ¼ inch and marking the origin of each resulting scratch, both an active diamond count and a map of the locations of the active diamonds can be obtained. This embodiment of the inventive method also does not require a layer of contrasting material, and scratches can be easily counted with the naked eye by backlighting the polycarbonate sheet and viewing it against a dark background.

The results of the method of the invention are easily reproducible and reliable. Moreover, the cost of implementing the inventive method is nominal, particularly where the final observation is by optical microscope and the material is a polycarbonate sheet. Furthermore, the method of the invention can easily be carried out with minimal equipment or preparation though there is nothing to suggest that specific equipment, existing or developed for this purpose, could not be applied to carry out this process in a reliable, trouble free and more reproducible manner particularly in an industrial context.

In the present invention, the hard surface consists of any hard smooth material, such as plastic, metal, glass or the like. Materials having a yield strength of between about 65 and about 75 MPa are preferred, and materials having a yield strength of at or near about 70 MPa are more preferred. Preferably the hard material is plastic and as the plastic referred to any hard plastic having a suitable yield strength may be used. Polycarbonate, acrylic, cellulose and the like are preferred plastics, with polycarbonate being more preferred. Preferred acrylic acid polymers include polymethacrylate and polymethylmethacrylate.

The color, transparency or appearance of the material is not particularly limited. Any contrastive color may be used for the layer of contrasting material, with black and dark blue being preferred. Except where profilometry is used to determine the number of scratches, transparent or translucent materials or materials having any degree of color or transparency or any appearance may be used, provided however that where optical methods are used to count the scratches, materials that are to a reasonable degree transparent or translucent and sufficiently visually distinguishable from the thin contrasting attachment or layer across which the scratches are made are preferred. Additionally, the solid polyurethane material used in the CMP pads is very suitable as the hard surface of the present invention, provided however that when such non-transparent materials are used, though optical methods of measuring the scratches are not ruled out, profilometry is preferred as the measurement method.

As to the form of the hard material, it may be in any suitable form, particularly as a flat surface of a table or flat workspace or a sheet laid upon or clamped to the same but sheets are preferred, particularly since sheets are inexpensive and easily replaceable between tests, and a permanent surface would require some form of treatment to remove the scratches. The dimensions of the hard surface are not particularly limited but should be sufficient to allow the disk to be moved entirely across the tinted band or other measurement zone, and preferably in the range of about 9 inches in length and about 5 inches in width. It is also desirable that the sheet of the present invention not be so large as to prevent or make difficult observation of the scratches by whatever means are chosen but typically by optical microscope. Dimensions of between about 5 inches and about 8 inches by between about 9 inches and about 12 inches are more preferred, and dimensions of about 8 inches by about 10 inches are even more preferred.

The thickness of the sheet is not particularly limited; however, the sheet should be stiff but still slightly flexible. If the sheet is too thin, the diamond conditioner disk may drag, deform or distort the sheet, thus rendering the number of scratches inaccurate. If the sheet is too thick it may be unwieldy and in cases, particularly where optical transparency or translucency is important for optical measurement or where profilometry is used, may make measurement less accurate. Also, if the sheet is too thick to bend slightly under load, thereby conforming to the flat work surface on which it has been placed, deviations in planarity inherent in the manufacturing process of the sheet may significantly affect the accuracy of the results.

The foregoing dimensions are based upon the present size of the diamond conditioner disk at 4 inches diameter. The dimensions may be adjusted appropriately to adjust for changes in the size of diamond conditioner disks.

The form and material of the layer of contrasting material are not particularly limited, and the layer typically only need be used when optical methods are used to count the number of scratches. A thin layer of contrasting material can be applied at any time but preferably is applied at the time of manufacture. For example, a tinted, dyed or pigmented layer can be prepared, painted or applied to the surface of the hard material at any time and either allowed to dry or hardened in some other way indicated by the nature of the material. When dried, hardened or fast, the material should not be so hard as to offer substantial resistance to the diamonds as they scratch the hard material.

On the other hand, the layer should not be so soft that a clear pattern of scratches cannot be reasonably obtained or maintained by the methods of this invention. The materials that can be used for the layer of contrasting material are not particularly limited. In some embodiments, indelible marker ink in a dark color is preferred particularly when the underlying hard material is transparent or white. In other embodiments, dyed or pigmented plastic materials similar to those preferred for use in the hard surface are preferred. The layer of contrasting material may be laminated by any manufacturing technique whereby a strip of material can be permanently incorporated onto another and techniques of lamination of two plastic layers by heat, pressure or, curing or adhesives may be used.

Furthermore, the layer of contrasting material may be laminated or fused into a depression in the hard surface corresponding to the dimensions of the contrasting layer so that the resulting surface is smooth, particularly if this is desirable for purposes of standardization or application with a mechanical device for convenience, precision and reliability. In any case, there should not, as a result of attaching the layer, be such a significant topographic variation in the hard surface as would interfere with the smooth motion of the diamond conditioner disk over the hard surface. Additionally the contrasting layer may consist of infusion or impregnation of pigment, dye or otherwise optically contrasting material at a shallow depth into that region of the hard surface that would correspond to the layer by any suitable means or of similar alteration of the hard surface to render it optically contrasting to such depth.

Where the thin layer of contrasting material is thus added to the hard surface material, the hardness of the layer is not particularly limited. Generally, a hardness similar to or less than that of the underlying hard material is preferred. However a layer of contrasting material that is softer than the underlying hard material should not be so soft or easily smeared or removed that it is difficult as a practical matter to retain the contrasting appearance of the scratches for later measurement.

The method of application of the layer of contrasting material is not particularly limited and the layer may be applied by coating, casting, curing, painting, spraying, wiping, marking, tinting, pigmenting, or dyeing the hard surface. In some embodiments, the layer of contrasting material is produced by attaching a separate layer to the hard surface, for example, by coating, casting, painting, etc. In other embodiments, the layer of contrasting material is produced by incorporating a material into the hard surface, for example, by dyeing, tinting, or pigmenting the hard surface. Those materials used in the preparation of the layer requiring time to dry or solidify should be given sufficient time to dry before making the scratches.

The dimensions of the layer of contrasting material are not particularly limited. Generally, the length should equal or exceed the diameter of the diamond conditioner disk being tested. Also generally the thickness should not be so thick that many of the active diamonds will not scratch their way through the layer to the hard surface during measurement. The layer should, however be thick enough to provide adequate contrast to detect the scratches. The layer preferably has a thickness between about 0.0001 inches and about 0.1 inches (e.g., about 0.001 inches and about 0.01 inches).

The position or orientation of the layer of contrasting material with respect to the surface of the hard material is not particularly limited. Any position or orientation that will allow the conditioner disk to be drawn entirely across the contrasting layer in a linear fashion can be used. However, it is preferred that the contrasting layer be placed midway down the length of the hard surface and that the longer axis of the contrasting layer be perpendicular to the direction in which the diamond conditioner disk is moved.

The number of active diamonds is, in part, a function of the load placed on the diamond conditioner disk and the load applied to the diamond conditioner disk is not otherwise limited. The load used in the present invention is selected to reflect actual use conditions of the disk. Loads that cause the total weight of the disk and load to be between about 2 pounds and about 25 pounds are preferred (e.g., between about 3 pounds and about 15 pounds, or between about 4 pounds and about 10 pounds).

The means of moving the diamond conditioner disk are not particularly limited, and the conditioner disk may be moved either manually or by a mechanical device prepared for that purpose. For example, the conditioner disk may be pushed, pulled, rotated or swung across the hard surface. Suitable mechanical devices include, for example, machines that are driven electromotively, magnetically, mechanically (for example by pistons, chains, screws, gears or levers), hydraulically, by gas pressure, by hanging the disk on the end of a pendulum and swinging it, or by tipping the polycarbonate sheet surface until the conditioner disk slides down the sheet at a reasonable rate.

An example of a mechanical device suitable for use in the inventive method is illustrated in FIG. 1. The device has a case (10) that is about 9 to about 12 inches deep, about 2.5 feet long, and about 1.5 feet wide. A motor (20) is affixed to inside of the forward wall. Inside the wall is a step down gear box (30). The smaller gear is attached to the motor (20) and the larger gear is attached to a screw (40) (diameter ⅓-½"") that runs the length of the case and is affixed with a fixture on the reverse inner wall so that it can rotate freely. The screw is stabilized by two metal strips (50). There is a rigid metal bar (60) (about 4 inches long about 1/16 inch thick about ¾ inches wide) that has a hole fitted loosely with a bolt fixture through which the screw is threaded. There is sufficient lubrication that the rigid metal bar (60) moves easily when the screw turns. The motor (20) is engaged so that the bar is pulled by the rotation of the thread in the direction of the head of the case and the motor. A polycarbonate sheet (70) as described in the Examples is placed between the head of the case and the rigid metal bar. There is a band (80) made by felt tip marker about halfway along the length and spanning the width of the polycarbonate sheet as described in the Examples. The rigid metal bar (60) is brought by rotation of the thread to the point where if a diamond conditioner disk (90) is placed diamond face down on the polycarbonate sheet the leading edge of the diamond conditioner disk just touches the trailing edge of the felt marker band (relative to the head of the case). The motor is engaged such that the diamond conditioner disk (90) moves across the felt marker band (80) in the direction indicated by the arrow. The speed of the rigid metal bar and disk is adjusted by a rheostat in the cable supplying current to the motor to the velocity indicated in the Examples. The movement is continued until the trailing edge of the diamond conditioner disk (90) is just touching the leading edge of the felt marker band.

Though movement of the conditioner disk is preferred, the hard surface may likewise be moved across the surface of the conditioner disk. The movement of the conditioner disk is preferably linear, though a curved course if carefully controlled may be considered for specific purposes, for example verification of faint scratches. Acceleration or deceleration may be used though a constant velocity is preferred. The velocity of the diamond conditioner disk across the surface of the hard material and the layer of contrasting material, if present, or other equivalent material is not limited but is preferably between about 0.25 inches per second and about 4 inches per second (e.g., between about 0.5 inches per second and about 3 inches per second). The velocity is more preferably between about 1 and about 2 inches per second. Depending upon the material, if the velocity is too small, scratching may be not be accomplished effectively but if the velocity is too great, the underlying material may be distorted in the direction of the movement, substantially decreasing accuracy and precision in the count.

The length of the scratches of the present invention is determined by the distance traveled by the diamond conditioner disk and preferably is long enough to entirely cross the layer of contrasting material. However, the scratches may be any length suitable for optical observation, microscopic optical observation, profilometric observation or any form of observation used with the present invention.

The means of observing the scratches are not particularly limited. In principle, various devices may be used to demonstrate the contrast between the scratches and the surrounding smooth surface. However, where optical contrast has been provided by the layer of contrasting material, observation by optical microscope is preferred. A profilometer or other topographic measurement technique may also be used and is particularly preferred where there is no layer of contrasting material or other visual means of contrasting the scratches are used.

Finally, in a slight modification on the preferred embodiment, in place of the hard material, an actual CMP pad may be used as the hard material across which the diamond conditioning pad is drawn, provided that the CMP pad is a solid material. In this case, it is preferred to measure the results using profilometry or a like topographic measurement technique.

The following examples further illustrate the invention but, of course, should not be construed as in any way limiting its scope.

EXAMPLE 1

This example demonstrates a method for determining the number of active diamonds on a diamond conditioner disk in accordance with the invention.

A polycarbonate sheet (GE Plastics XL10 Lexan™) having dimensions of 8×10" by 3/32" thick was placed on a ⅜" thick glass plate with a flat, clean surface and onto which constraints had been attached to prevent the horizontal and vertical motion of the sheet. The constraining devices consisted of strips of polycarbonate with at least one straight edge, rectangular aluminum blocks, and metal rulers, all of which were attached to the glass plate with double sided tape. A series of contiguous lines were drawn on the polycarbonate sheet using a black indelible felt pen so that the total thickness of the marker band created thereby was approximately ⅛ inch centered approximately halfway down the longer axis of the sheet, and perpendicular to that axis.

A used 4.25" diameter Mitsubishi Materials Corporation Triple Ring Dot (MMC TRD) diamond conditioner disk with a total of approximately 202,000 visible 200 grit diamonds on the working surface was placed diamond face down with its leading edge just touching the closer side of the indelible felt tip maker band and with one edge just touching the left-hand constraint of the sheet. Metal weights, which together with the diamond conditioning disk totaled 7.37 pounds, were placed on the top of the disk. The conditioner disk and metal weights were moved by pushing them from the back using a rectangular Melamine block across the indelible felt tip marker band at right angles to the longest dimension of the band at a rate of about 1 inch per second until the trailing edge of the disk had crossed the far edge of the indelible felt tip marker band. The disk and weight were removed, the sheet was removed and the number of scratches was counted using an optical microscope (Nikon SMA-10, 10× magnification). The sheet was viewed with lighting from above.

Figure 2:
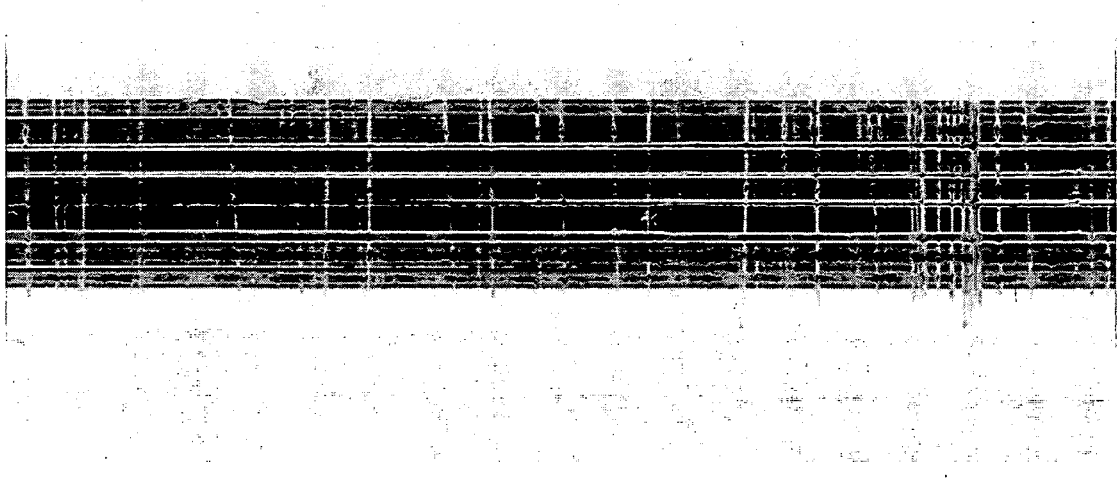
FIG. 2 is a photograph of a portion of a band of contrasting material showing scratches produced by active diamonds on a 200 grit MMC TRD conditioner disk at 7.37 lbf.

A portion of the band showing scratches resulting from the movement of the diamond conditioner disk as described is shown in FIG. 2. A total of 343 individual scratches were counted, corresponding to 343 active diamonds, were counted using a Nikon SMA-10 optical microscope at 10× magnification.

EXAMPLE 2

This example demonstrates the consistency of the inventive method for determining the number of active diamonds on a diamond conditioner disk.

Two repeat trials were performed using the same method as in Example 1 at 7.37 lbf. A mark on the edge of the diamond conditioner disk was aligned with a mark on the polycarbonate sheet placed at half of the conditioner disk diameter from the left constraint to insure that the conditioner disk had the same orientation relative to the sliding direction for each trial. A total of 393±21 scratches were counted for the first repeat trial by two individuals and 327 for the second repeat trial. Relative to Example 1, the two repeat trials deviate by 14.5% and 4.7% respectively.

EXAMPLE 3

This example demonstrates another method for determining the number of active diamonds on a diamond conditioner disk using profilometry in accordance with the invention.

Figure 3:
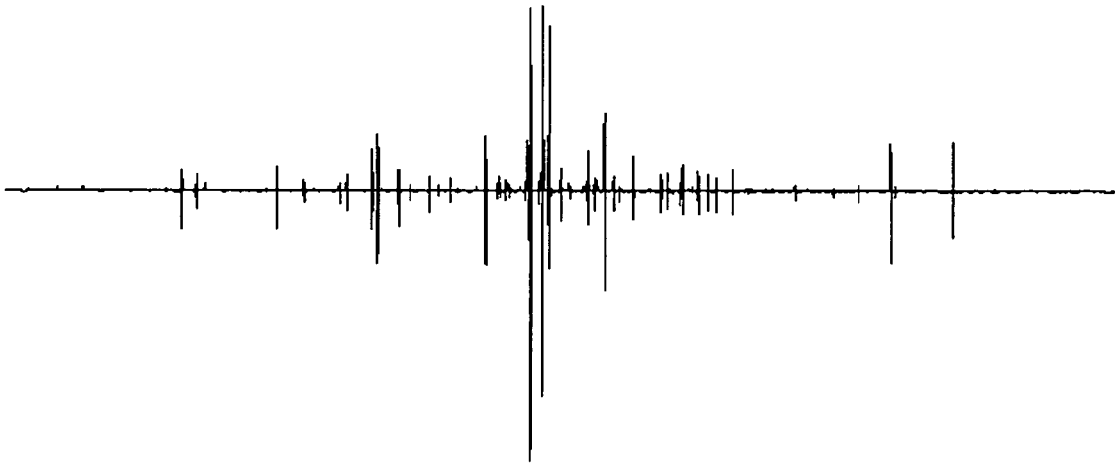
FIG. 3 is a scanning profilometry plot of scratches detected in a band of contrasting material produced by active diamonds on a 200 grit MMC TRD conditioner disk.

A scanning stylus profilometer (Dektak V200 SI, Veeco Corp.) with a three micron radius probe tip, a horizontal step of 2.778 microns, and a vertical resolution of 0.26 microns was used to scan the surface of the polycarbonate sheet from the first repeat trial in Example 2. The scan line was 100 mm long and located just above the color contrast band. After data acquisition, variations in surface height due to tilt and non-planarity of the polycarbonate sheet were mathematically removed by constructing a 1000 point running average and subtracting it from the raw height data. The resulting scanning profilometry plot is shown in FIG. 3.

Scratches were then counted automatically using custom software constructed to identify scratches that produce surface variations above the noise level of an unmarked polycarbonate sheet surface. Scratch counts were verified by manual examination of the profilometry scan. A total of 201 scratches were found using profilometry. Relative to the optical method, 49% fewer scratches were detected with profilometry since some scratches are either discontinuous and do not cross the scan line or do not sufficiently exceed the noise level of the surface.

EXAMPLE 4

This example demonstrates a method for determining the number of active diamonds on a diamond conditioner disk using a mechanical device to move the disk in accordance with the invention.

The test in Example 1 was performed at 7.37 lbf using a mechanical device to move the conditioner disk and metal weight stack. The device pushed the conditioner disk using a metal bar connected to a screw driven by an electric motor with gear reduction. The sliding velocity was approximately 1 inch per second. A total of 333±10 scratches were counted in the contrast mark by one individual using an optical microscope.

EXAMPLE 5

This example demonstrates a method for determining the number of active diamonds on a diamond conditioner disk in accordance with the invention.

The diamond conditioner disk from Example 1 was measured at 7.37 lbf using a variation of the method that involves a short sliding distance and that that does not use a layer of contrasting material. The polycarbonate sheet was placed on a ⅜ inch thick glass plate with constraints on the left side and bottom. An alignment mark was drawn on the sheet at a distance from the left constraint equal to one half of the conditioner disk diameter. The conditioner disk and weight stack were then placed on the polycarbonate sheet so that one edge was touching the left-hand constraint of the sheet and so that a mark on the edge of the conditioner disk was coincident with the alignment mark on the sheet. A constraint consisting of a rectangular block of aluminum was then attached with double-sided tape to the polycarbonate sheet along the right-hand side of the conditioner and weight stack.

Figure 4:
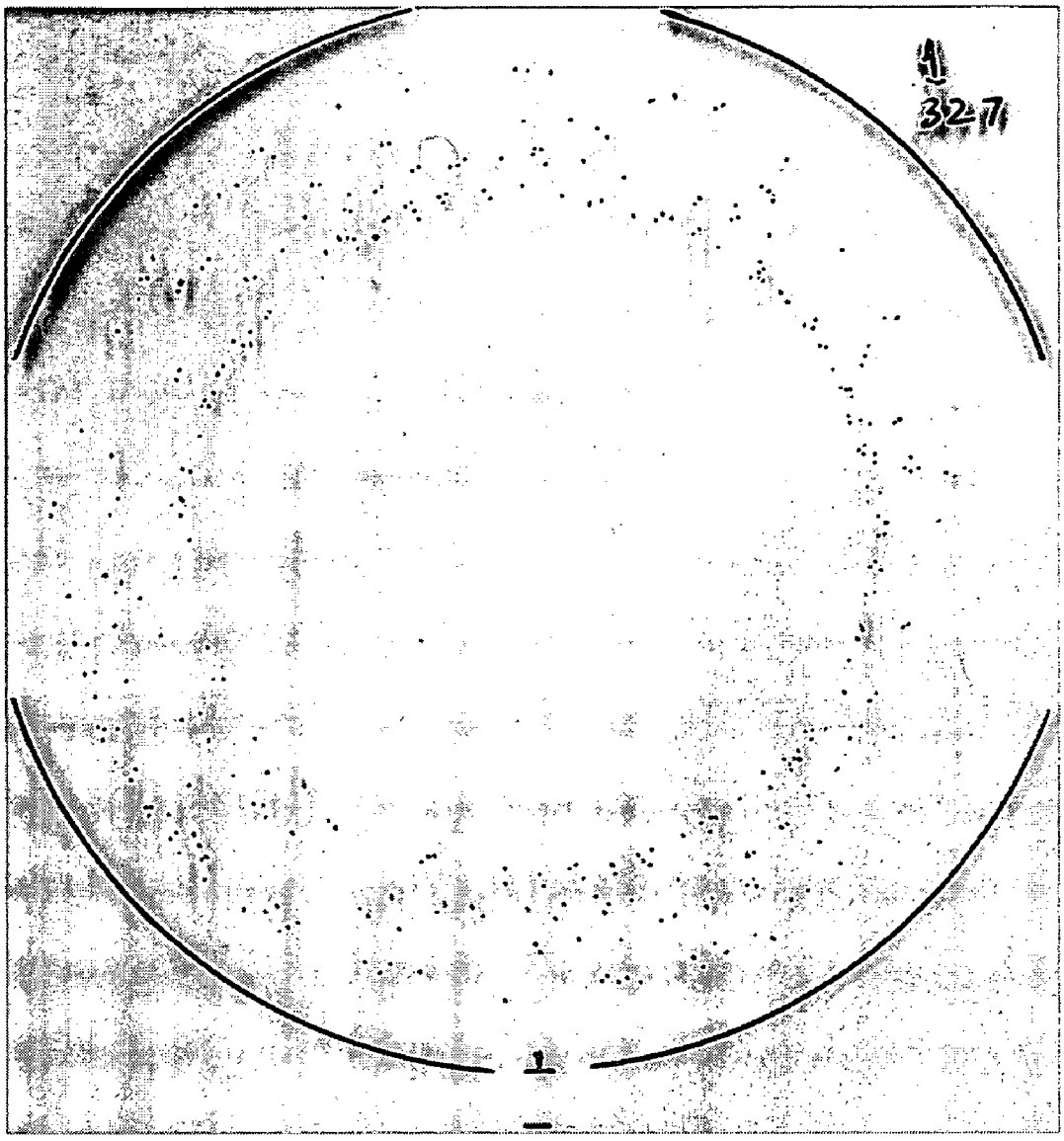
FIG. 4 is a photograph of the initial positions of scratches marked with a fine-tipped felt pen produced by a 200 grit MMC TRD conditioner disk.
Figure 5:
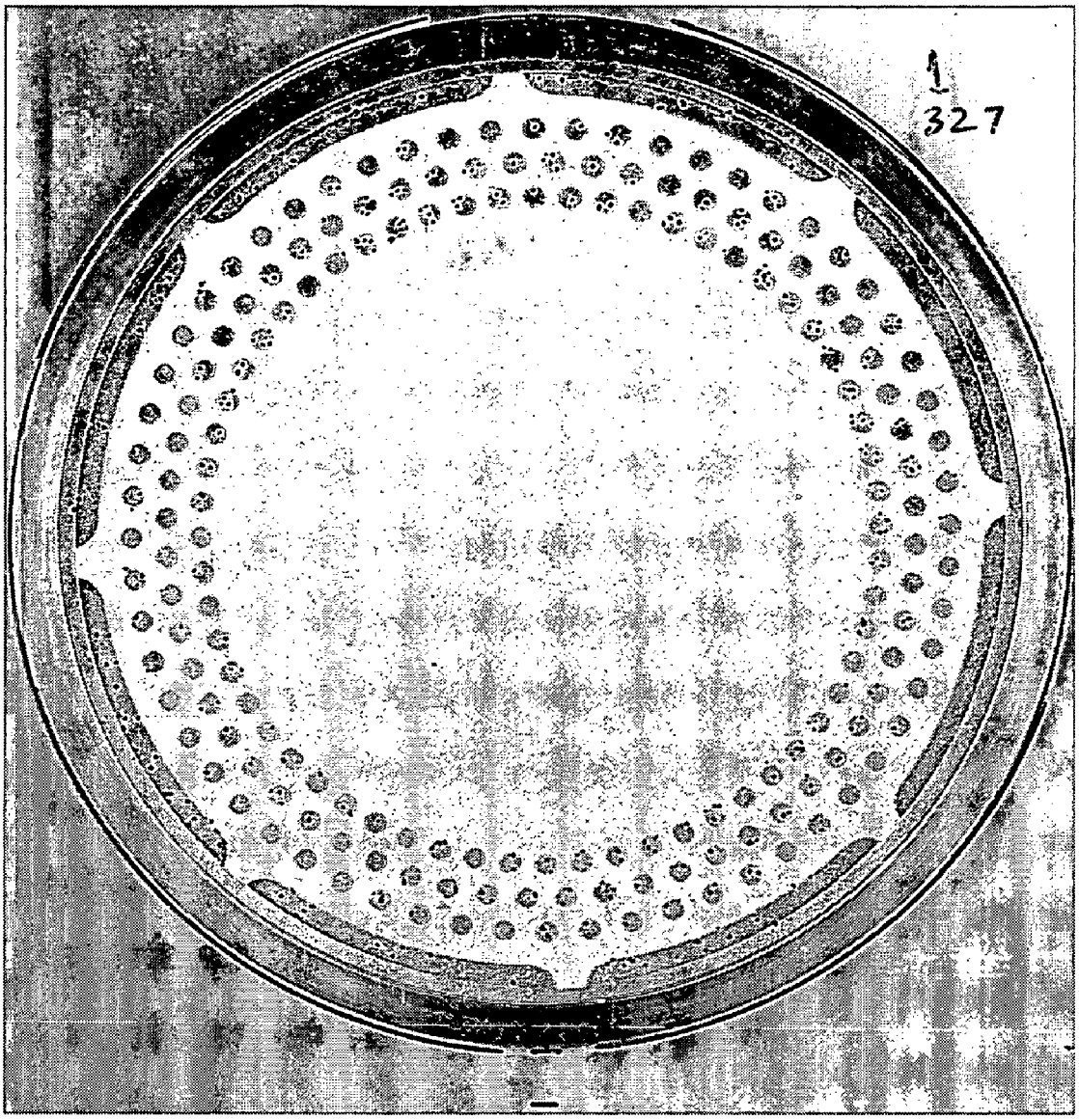
FIG. 5 is a photograph of an overlay of the scratch origins shown in FIG. 4 onto the MMC TRD conditioner disk working face.

A fine-tipped felt pen was then used to outline the initial position of the diamond conditioner disk. The conditioner disk and weight stack were then pushed from behind for a total distance of ¼" using a Melamine block. The conditioner disk, weight stack, and polycarbonate sheet were removed and the polycarbonate sheet was examined visually using backlighting to highlight the scratches and without using a microscope. The origin of each scratch was marked with a fine-tipped felt pen. A total of 327 scratches were identified. FIG. 4 shows the marked locations of the scratch origins (sliding was from top to bottom). A mark labeled "1" on the conditioner disk was placed above the alignment mark on the polycarbonate sheet before the test. FIG. 5 overlays the locations of the scratch origins (dark spots) on the working face of the MMC TRD conditioner disk.

EXAMPLE 6

This example demonstrates the consistency of the inventive method for determining the number of active diamonds on a diamond conditioner disk.

The method in Example 5 was applied at 7.37 lbf using seven additional initial orientations of the diamond conditioner disk. For each of the seven tests, the conditioner disk was incrementally rotated counter clockwise by 45 degrees relative to the previous orientation. Scratch origin counts are listed in Table 1.

TABLE 1

| | Scratch origin (active diamond) count versus conditioner rotation angle in degrees. | | | | | | | |
|---|---|---|---|---|---|---|---|---|
| Angle | 0 | 45 | 90 | 135 | 180 | 225 | 270 | 315 |
| Count | 327 | 328 | 342 | 377 | 314 | 315 | 311 | 326 |

EXAMPLE 7

This example demonstrates the effect of different loads on the inventive method for determining the number of active diamonds on a diamond conditioner disk.

Figure 6:
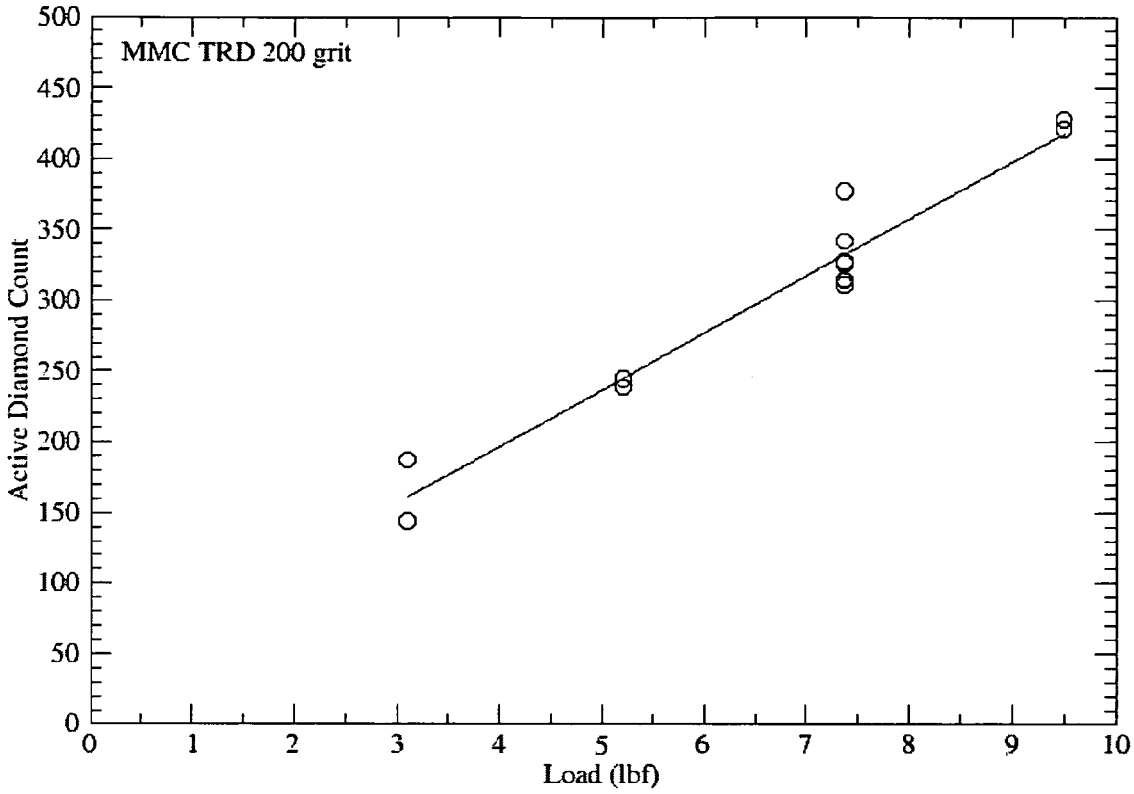
FIG. 6 is a plot of 200 grit MMC TRD active diamond count versus total load.

The method in Example 5 was applied using loads of 3.1 lbf, 5.2 lbf and 9.5 lbf. One repeat measurement was performed at each load after rotating the conditioner disk by 45 degrees. Total active diamond counts are plotted in FIG. 6 as a function of the total load. The regression line in the graph of FIG. 6 does not pass through the origin since some diamonds are needed to support the disk even at very light loads.

EXAMPLE 8

This example demonstrates the different results obtained using the inventive method for determining the number of active diamonds on a diamond conditioner disk when the conditioner disk is new compared to used.

Figure 7:
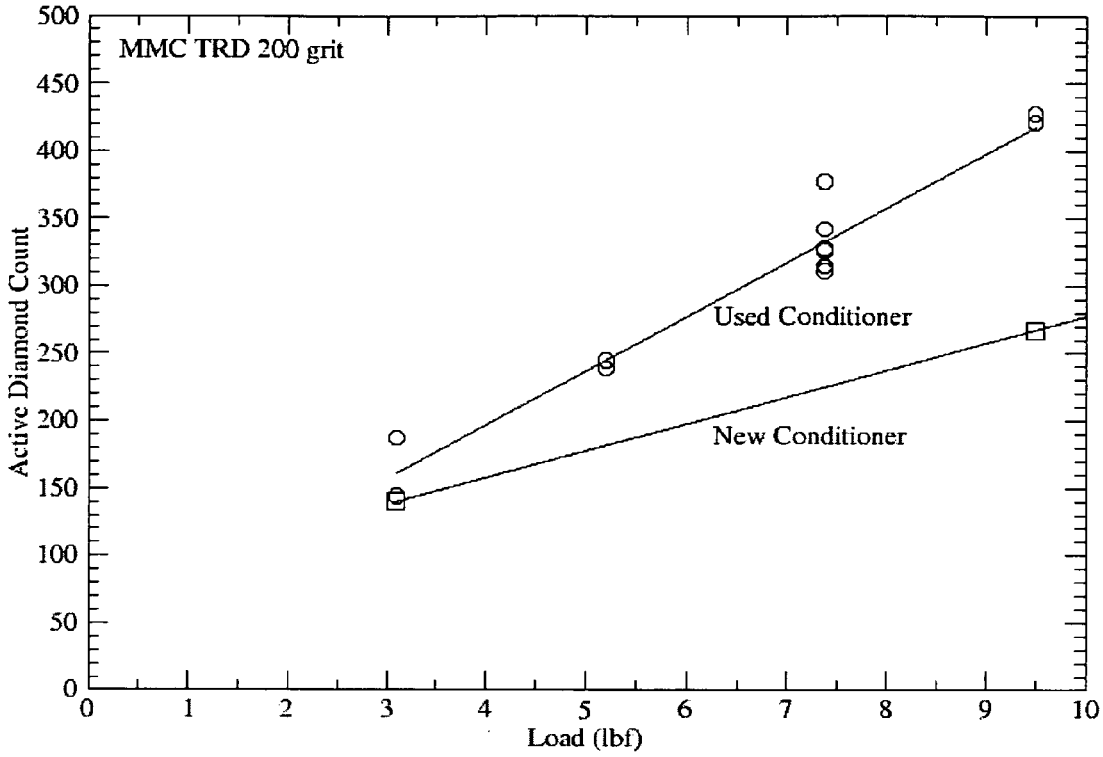
FIG. 7 is a plot of 200 grit MMC TRD active diamond count versus total load comparing a new conditioner disk to a used conditioner disk.

Diamond count data was collected on the MMC TRD 200 grit conditioner disk using the method in Example 1 when the conditioner disk was new. Active diamond counts for the new conditioner disk at two loads are compared with active diamond counts for the same conditioner disk after use in FIG. 7. The results suggest that the active diamond count increases as the conditioner wears.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for determining the number of active diamonds on a diamond conditioner disk, comprising:

(a) contacting a diamond conditioner disk with a hard surface, wherein the diamond-containing side of the diamond conditioning disk is facing the hard surface, (b) moving the diamond conditioner disk under a load across the hard surface so as to cause any active diamonds present on the diamond-containing side of the diamond conditioner disk to leave a mark corresponding to each active diamond, and (c) counting the marks to determine the number of active diamonds on the diamond conditioner disk.

2. The method of claim 1, wherein the hard surface has a yield strength of about 65 MPa to about 75 MPa.

3. The method of claim 1, wherein the hard surface comprises a plastic.

4. The method of claim 1, wherein the hard surface is in the form of a sheet.

5. The method of claim 4, wherein the hard surface is a plastic sheet.

6. The method of claim 5, wherein the plastic sheet is transparent or translucent.

7. The method of claim 6, wherein the transparent or translucent plastic sheet comprises a hard polymer plastic material selected from the group consisting of polycarbonate, polymethacrylate, and polymethylmethacrylate.

8. The method of claim 1, wherein the hard surface comprises polyurethane.

9. The method of claim 1, wherein the load is between about 2 and about 25 pounds.

10. The method of claim 1, wherein the diamond conditioner disk moves between about 0.001 inch and about half an inch.

11. The method of claim 10, wherein the diamond conditioner disk moves linearly between about ⅜ and about ⅝ inches.

12. The method of claim 1, wherein the mark left corresponding to each active diamond is a scratch in the hard surface.

13. A method for determining the number of active diamonds on a diamond conditioner disk, comprising:

(a) contacting a diamond conditioner disk with a hard surface, wherein the diamond-containing side of the diamond conditioning disk is facing the hard surface, (b) moving the diamond conditioner disk under a load across the hard surface so as to cause an active diamonds present on the diamond-containing side of the diamond conditioner disk to leave a mark corresponding to each active diamond, and (c) counting the marks to determine the number of active diamonds on the diamond conditioner disk, wherein the hard surface further comprises a layer of contrasting material such that when the diamond conditioner disk moves across the hard surface, the diamond conditioner disk passes the layer entirely from one end to the other and scratches the layer of contrasting material on the hard surface thereby leaving a mark.

14. The method of claim 13, wherein the layer of contrasting material is applied to the hard surface by coating, casting, curing, painting, spraying, wiping, marking, tinting, or dyeing.

15. The method of claim 13, wherein the layer of contrasting material has a contrasting color.

16. The method of claim 15, wherein the layer is a tinted, dyed, or pigmented layer.

17. The method of claim 13, wherein the layer of contrasting material has a contrasting hardness.

18. The method of claim 13, wherein the layer of contrasting material comprises the pigmented material left by an indelible felt marker or similar marking or coloring device.

19. The method of claim 13, wherein the hard surface is a transparent or translucent plastic sheet.

20. The method of claim 19, wherein the transparent or translucent plastic sheet comprises a hard polymer plastic material selected from the group consisting of polycarbonate, polymethacrylate, and polymethylmethacrylate.

21. The method of claim 13, wherein the layer of contrasting material consists of a plastic sheet having a thickness of between about 0.001 inches and about 0.1 inches and a dark translucent color that is laminated or sealed to the hard surface.

22. The method of claim 13, wherein the mark left corresponding to each active diamond is a scratch in the layer of contrasting material.

23. A method for determining the number of active diamonds on a diamond conditioner disk, comprising:

(a) contacting a diamond conditioner disk with a hard surface wherein the diamond-containing side of the diamond conditioning disk is facing the hard surface, (b) moving the diamond conditioner disk under a load across the hard surface so as to cause any active diamonds present on the diamond-containing side of the diamond conditioner disk to leave a mark corresponding to each active diamond, and (c) counting the marks to determine the number of active diamonds on the diamond conditioner disk, wherein the marks are counted using a profilometer.

24. The method of claim 23, wherein the hard surface comprises polyurethane.

25. A method for determining the number of active diamonds on a diamond conditioner disk, comprising:

(a) contacting a diamond conditioner disk with a hard surface, wherein the diamond-containing side of the diamond conditioning disk is facing the hard surface, (b) moving the diamond conditioner disk under a load across the hard surface so as to cause any active diamonds present on the diamond-containing side of the diamond conditioner disk to leave a mark corresponding to each active diamond, and (c) counting the marks to determine the number of active diamonds on the diamond conditioner disk, wherein the marks are counted using an optical microscope.

26. The method of claim 25, wherein the hard surface comprises polyurethane.

27. The method of claim 25, wherein the hard surface is a rectangular polycarbonate sheet that is clamped to a flat work surface, the hard surface further comprising a layer of contrasting material consisting of a band of constant width applied by marking the hard surface with an indelible felt tipped marker across the upper surface of the polycarbonate sheet perpendicular to the longer axis of the polycarbonate sheet, and wherein the diamond conditioner disk contacts the hard surface such that the lead edge of the disk is at or near the beginning of the band, and wherein the diamond conditioner disk is moved at a constant velocity parallel to the longer axis of the polycarbonate sheet so that the diamond-containing surface of the disk completely passes over the felt marker band.

28. The method of claim 25, wherein the hard surface further comprises a layer of contrasting material such that when the diamond conditioner disk moves across the hard surface, the diamond conditioner disk passes the layer entirely from one end to the other and scratches the layer of contrasting material on the hard surface thereby leaving a mark.

29. A method for determining the number of active diamonds on a diamond conditioner disk, comprising:

(a) contacting a diamond conditioner disk with a hard surface, wherein the diamond-containing side of the diamond conditioning disk is facing the hard surface, (b) moving the diamond conditioner disk under a load across the hard surface so as to cause any active diamonds present on the diamond-containing side of the diamond conditioner disk to leave a mark corresponding to each active diamond, and (c) counting the marks to determine the number of active diamonds on the diamond conditioner disk, wherein the hard surface is a rectangular polycarbonate sheet that is clamped to a flat work surface, the hard surface further comprising a layer of contrasting material consisting of a band of constant width applied by marking the hard surface with an indelible felt tipped marker across the upper surface of the polycarbonate sheet perpendicular to the longer axis of the polycarbonate sheet, and wherein the diamond conditioner disk contacts the hard surface such that the lead edge of the disk is at or near the beginning of the band, and wherein the diamond conditioner disk is moved at a constant velocity parallel to the longer axis of the polycarbonate sheet so that the diamond-containing surface of the disk completely passes over the felt marker band.

30. The method of claim 29, wherein the diamond conditioner disk is moved mechanically at a constant velocity parallel to the longer axis.

31. A method for determining the number of active diamonds on a diamond conditioner disk, comprising:

(a) contacting a diamond conditioner disk with a hard surface, wherein the diamond-containing side of the diamond conditioning disk is facing the hard surface, (b) moving the diamond conditioner disk under a load across the hard surface so as to cause any active diamonds present on the diamond-containing side of the diamond conditioner disk to leave a mark corresponding to each active diamond, and (c) counting the marks to determine the number of active diamonds on the diamond conditioner disk, wherein the hard surface further comprises a layer of contrasting material such that when the diamond conditioner disk moves across the hard surface, the diamond conditioner disk passes the layer entirely from one end to the other and scratches the layer of contrasting material on the hard surface thereby leaving a mark, and wherein the marks are counted using an optical microscope.

* * * * *